US008877346B2

(12) United States Patent
Lambrechts et al.

(10) Patent No.: US 8,877,346 B2
(45) Date of Patent: Nov. 4, 2014

(54) LONGITUDINAL BELT WITH REINFORCING FIBRES

(75) Inventors: Ann Lambrechts, Avelgem (BE); David Mertens, De Pinte (BE); Krist Dellaert, Zottegem (BE); Guido Backers, Oekene (BE)

(73) Assignee: NV Bekaert SA, Zwevegem (BE)

( * ) Notice: Subject to any disclaimer, the term of this patent is extended or adjusted under 35 U.S.C. 154(b) by 191 days.

(21) Appl. No.: 13/129,966

(22) PCT Filed: Nov. 23, 2009

(86) PCT No.: PCT/EP2009/065630
§ 371 (c)(1),
(2), (4) Date: May 18, 2011

(87) PCT Pub. No.: WO2010/078995
PCT Pub. Date: Jul. 15, 2010

(65) Prior Publication Data

US 2011/0223377 A1 Sep. 15, 2011

(30) Foreign Application Priority Data

Jan. 9, 2009 (EP) ..... 09150267

(51) Int. Cl.

| | |
|---|---|
| ***E04C 5/01*** | (2006.01) |
| ***B28C 5/40*** | (2006.01) |
| ***E04C 5/07*** | (2006.01) |
| ***B65D 73/02*** | (2006.01) |

(52) U.S. Cl.
CPC ..... *E04C 5/012* (2013.01); *B28C 5/402* (2013.01); *E04C 5/076* (2013.01); *B65D 73/02* (2013.01)
USPC ..... 428/605; 428/294.7; 106/644

(58) Field of Classification Search
None
See application file for complete search history.

(56) References Cited

U.S. PATENT DOCUMENTS

| | | | | |
|---|---|---|---|---|
| 1,942,249 | A * | 1/1934 | Kleinschmit | 59/71 |
| 2,719,804 | A * | 10/1955 | Carlson | 428/110 |
| 2,804,972 | A | 9/1957 | Anderson | |
| 4,089,439 | A | 5/1978 | Dearlove et al. | |
| 4,273,601 | A * | 6/1981 | Weingart | 156/189 |
| 4,284,667 | A * | 8/1981 | Moens | 427/331 |
| 4,575,176 | A * | 3/1986 | Castello et al. | 439/660 |
| 4,590,105 | A * | 5/1986 | Shaffer | 428/8 |
| 5,042,535 | A * | 8/1991 | Schlottke | 140/93 A |
| 5,706,952 | A * | 1/1998 | Bianca et al. | 206/713 |
| 6,550,362 | B1 | 4/2003 | Galinat et al. | |
| 6,562,430 | B1 * | 5/2003 | Leon | 428/43 |
| 2004/0109979 | A1 * | 6/2004 | Dewinter | 428/114 |
| 2006/0070341 | A1 * | 4/2006 | Schmidt et al. | 52/740.1 |

FOREIGN PATENT DOCUMENTS

| | | | |
|---|---|---|---|
| CH | 673306 | A5 | 2/1990 |
| EP | 0 557 617 | A1 | 9/1993 |
| EP | 1 383 634 | B1 | 10/2006 |

(Continued)

*Primary Examiner* — John J Zimmerman
(74) *Attorney, Agent, or Firm* — Foley & Lardner LLP

(57) ABSTRACT

A belt (1) for dosing reinforcing fibres (3) during the manufacture of fibre concrete material or fibre composite material comprises at least one longitudinal supporting element (2) and the reinforcing fibres (3). The fibres (3) are applied transversely or under angle different from 0° with respect to the supporting element (2). The fibres (3) are connected to the at least one longitudinal supporting element (2). The advantage of this way of dosing fibres in concrete is that the filling of sacks or bags is avoided and that the amount of foreign material getting in the concrete material is limited.

14 Claims, 2 Drawing Sheets

(56) References Cited

FOREIGN PATENT DOCUMENTS

Figure 1:
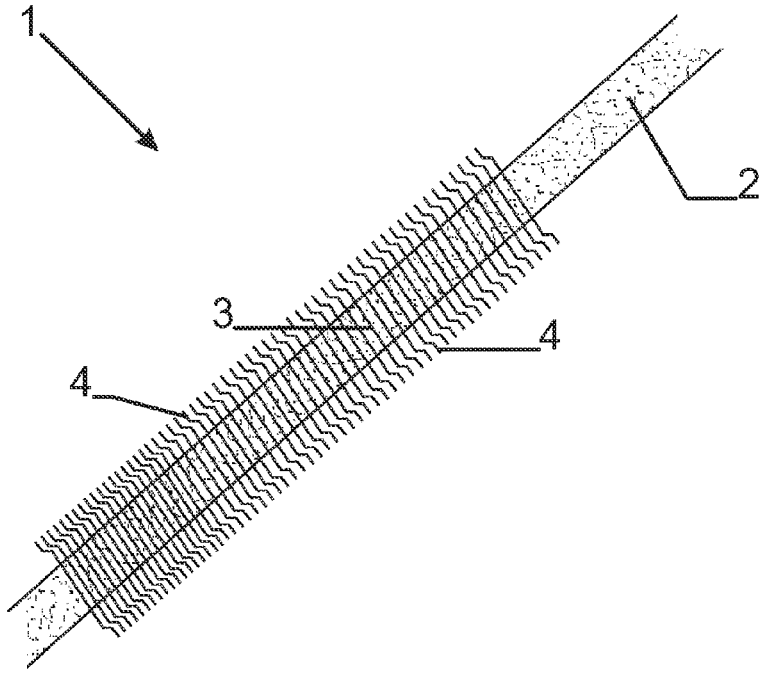

| | | | |
|---|---|---|---|
| FR | 2 741 323 | A3 | 5/1997 |
| GB | 1 256 036 | | 12/1971 |
| GB | 1 328 568 | | 8/1973 |
| WO | WO 01/55046 | A2 | 8/2001 |
| WO | WO 02/48476 | A1 | 6/2002 |
| WO | WO 02/090074 | A1 | 11/2002 |

* cited by examiner

LONGITUDINAL BELT WITH REINFORCING FIBRES

TECHNICAL FIELD

This invention relates to a method for dosing reinforcing fibres during the manufacture of fibre concrete material or fibre composite material, said method comprising the step of providing a belt comprising at least one longitudinal supporting element and the reinforcing fibres. It will appreciated that "fibres " and "fibre ",respectively have the same meaning as "fibers, " and "fiber ".

BACKGROUND ART

Such a method is already known from WO 02/090074 (EP 1383634 B1) and U.S. Pat. No. 6,550,362 B1.

From these cited patents, it is already known to use methods and belts comprising reinforcing fibres, whereby it is not longer necessary to weigh the amount of fibres during the dosing operation at the mixing plant or building yard itself. Thanks to these known methods and belts in the form of a chain packing of sacks; the former weighing operations of the reinforcing fibres at the mixing plant are replaced by a measuring operation of the length of the continuous belt or a counting operation of the number of supplied sacks to a mixing silo at the mixing plant.

A disadvantage of the use of such a chain packing of sacks is the rather cumbersome filling operation of the sacks during the manufacturing of the chain packing of sacks.

Another disadvantage of the use of such known belts in the form of a chain packing of sacks follows from the fact that a rather great amount of foreign material, such as paper from the package of the sacks, is added to the components of the fibre concrete material or fibre composite material.

By fibre concrete material or fibre composite material is understood all curing composite materials, provided with reinforcing fibres, such as steel fibres, glass fibres and synthetic fibres, such as polypropylene fibres to improve the properties of the curable composite material.

DISCLOSURE OF INVENTION

It is an object of the present invention to provide a new method of dosing reinforcing fibres during the manufacture of fibre concrete material of fibre composite material, whereby the above-mentioned disadvantages are greatly reduced.

Therefore, a method of the type described in the opening lines is proposed, in which the fibres are applied transversely or, more generally, under an angle different from 0° with respect to the at least one longitudinal supporting element and in which the fibres are connected to at least one longitudinal supporting element.

Thanks to this new method according to the invention, the above-mentioned disadvantages are greatly reduced or completely eliminated.

In a preferred embodiment of the method according to the invention, this at least one longitudinal supporting element is formed by a strip, whereby the width of this strip is preferably smaller than the length of the reinforcing fibres.

A further preferred embodiment of the method according to the invention is characterised in, that the fibres are applied substantially parallel to each other. Preferably, the fibres are glued to the at least one longitudinal supporting element.

Preferably the glue is a water soluble glue. Other ways of sticking the fibres to the supporting element are stitching or knitting.

In still a further preferred embodiment of the method according to the invention, the belt comprises two longitudinal supporting elements, which preferably form the side edges of the belt.

Preferably, the ends of the fibres have closed loops and the two longitudinal supporting elements are guided through these loops.

It is to be noted, that fibres with closed loops ends are already known, as such, from GB 1328568 and WO 01/55046.

A further preferred embodiment of the method according to the invention is characterised in, that at preset intervals at least one reinforcing fibre is provided with a marking sign.

Preferably, the longitudinal supporting elements can disintegrate into the concrete or composite material, to be reinforced, during the manufacture of this reinforced material.

This invention also relates to a belt for carrying out the method according to the invention. In such a belt, the fibres are steel fibres, the diameter of the fibres varies between 0.10 mm to 1.4 mm and the length-diameter ratio varies between 10 and 200.

BRIEF DESCRIPTION OF FIGURES IN THE DRAWINGS

Figure 2:
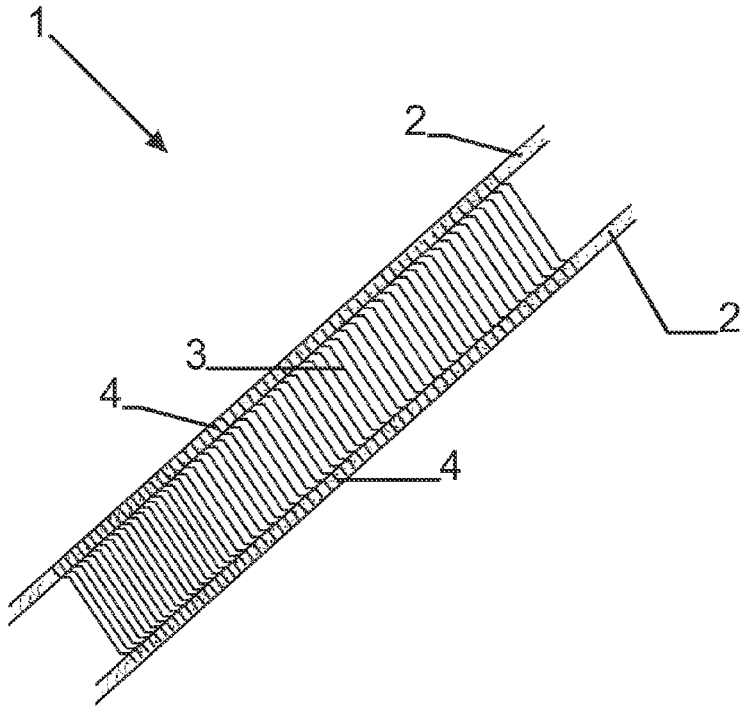
Figure 3:
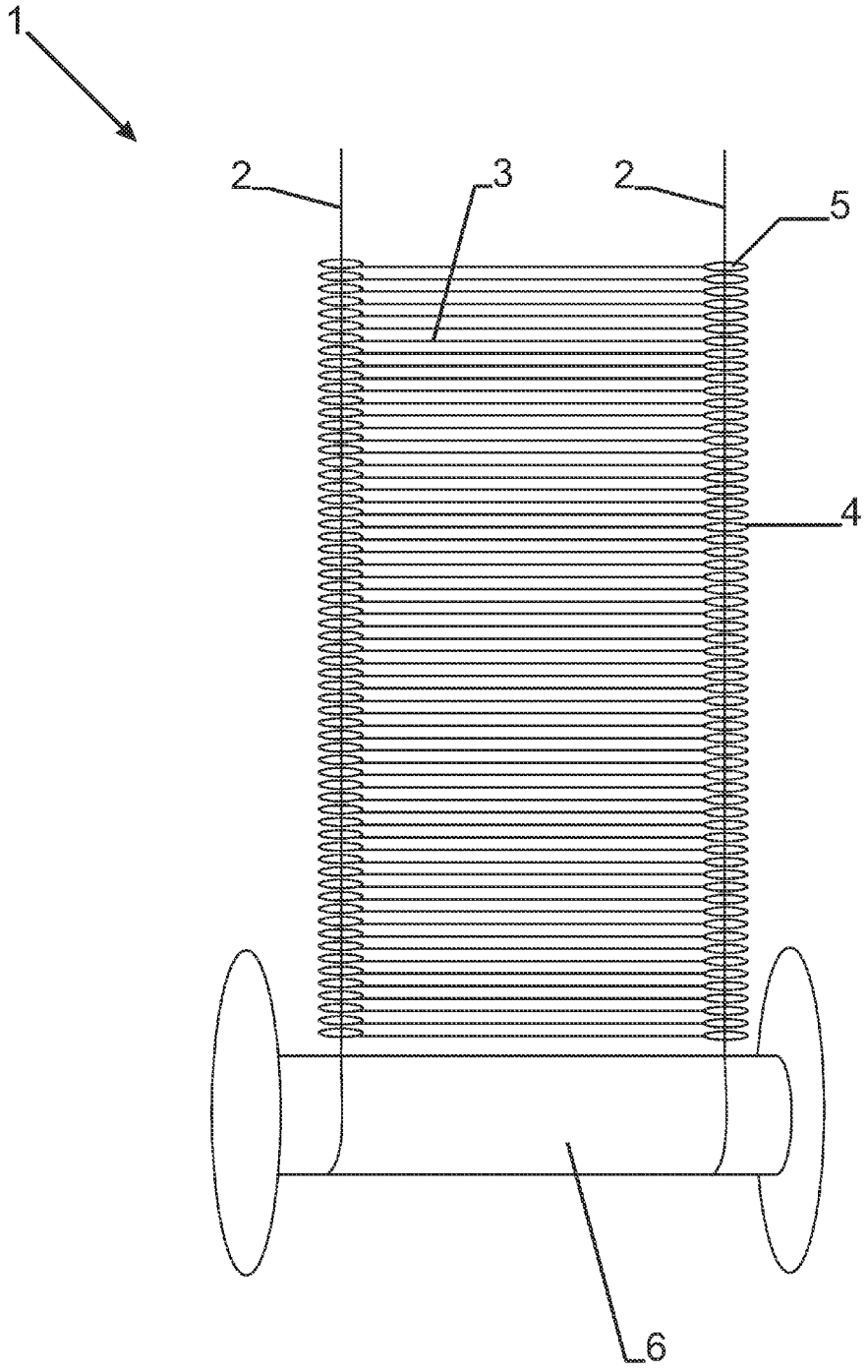

The invention will be further explained in the following description by means of the accompanying drawing, wherein:

FIGS. 1 and 2 show, both schematically and in perspective, two possible embodiments of a belt used in the method according to the invention, FIG. 3 shows a third embodiment of a belt used in a method according to the invention, which belt is wound up a bobbin.

MODE(S) FOR CARRYING OUT THE INVENTION

The belt for carrying out the method according to the invention is generally indicated by number 1 in FIG. 1. The belt 1 comprises a longitudinal supporting element 2 and a very great number of reinforcing fibres 3.

As can be seen from FIG. 1, the reinforcing fibres 3 are applied transversely with respect to this longitudinal supporting element 2 and mainly mutually parallel to each other.

The longitudinal supporting element 2 is in the form of a strip 2, whereby the width of this strip is smaller than the length of the reinforcing fibres 3. The width of the strip 2 can be greater than the length of the fibres 3; but preferably this width is substantially smaller than the length of the fibres 3. It is to be noted, that such a belt is substantially learned in U.S. Pat. No. 2,804,972 for manufacturing bristles.

The strip 2 is e.g. made from cellulose or a cellulose-based foil with addition of water-soluble glue and fillers, which strip is disintegratable in water. The fibres are connected to the strip 2 by means of a special glue, which is also water-soluble.

The reinforcing fibres 3 can be made of all sorts of materials. This depends on the demands required of the fibres and on the fibre concrete material or fibre composite material to be reinforced with the fibres. Preferably, steel reinforcing fibres 3 are used, sold amongst others by the applicant NV Bekaert SA under the trademark DRAMIX. Mostly, steel fibres are used with a tensile strength comprised e.g. between 500 and 3000 Newton/mm$^2$.

The used fibres 3 can e.g. be straight or straight with bent ends. The reinforcing fibres 3 have preferably a form that makes it rather difficult to pull them out of the cured concrete material using a tensile strain. To that end, the fibres are e.g. corrugated or their cross-section-surface varies along the length. For steel fibres, the thickness or diameter preferably varies from 0.10 mm to 1.4 mm, e.g. from 0.12 mm to 1.2 mm. The length-diameter ratio for steel fibres is, for practical and economical reasons, mostly situated between 10 and 200 and preferably minimally amounts to 40. A suitable maximum is 100.

FIG. 2 shows substantially the same belt 1 as shown in FIG. 1, whereby the belt 1 now comprises two longitudinal supporting strips 2, which form the side edges of the belt 1. The width of the strips 2 is now substantially equal to the length of the bent ends 4 of the fibres 3.

FIG. 3 shows a further possible embodiment of a belt 1 according to the invention. In this embodiment, the end sections 4 of the fibres 3 are shaped to form closed loops 5, whereby the two longitudinal supporting elements 2 in the form of a wire or a narrow strip are guided through these closed loops 5 for connecting the fibres 3 to the longitudinal elements 2. The loops 5 of the fibres 3 can be circular, triangular, . . . or show any other shape, suitable for fixing or connecting the end sections 4 of the fibres 3 to the two longitudinal elements 2. The end sections 4 may have a cross-section which is the same or different from the cross-section of the middle part of the reinforcing fibres.

The longitudinal wires or strips 2, guided through the loops 5, can be made from all kinds of materials, which can partially or totally disintegrate in the material, to be reinforced. Such materials are e.g. glass fibres, steel wires with a small diameter, . . . By total or partial disintegration of such materials is to be understood, that the longitudinal elements 2 are completely or partially broken during the mixing operation or manufacture of the reinforced material. It is to be noted, that such a belt is substantially learned in the CH patent 673306, whereby this belt is provided with a limited number of binding wires for connecting reinforcement iron.

As can be seen from FIG. 3, the strip 1 can be wound up a reel or bobbin 6 for transportation purposes. It is to be mentioned, that the dimensions of the bobbin 6 are normally much greater than the dimensions of the reinforcing fibres 3. The length of the core of the bobbin 6 can be e.g. at least five times or more the length of the fibres 3. Alternative ways of storing the strip are winding the strips on small cylinders, wrapping the strips in small-sized, medium-sized or big-sized bags.

The application or connecting operation of the fibres 3 to the longitudinal supporting elements 2 is preferably executed in line with the actual production of the fibres, e.g. steel fibres. In case of steel fibres, it is possible to place the steel fibres 3 in a mainly mutually parallel position by means of magnetic forces.

It is also advisable to count or weigh the number of applied adjacent steel fibres 3 during the application of the fibres 3 on the supporting elements 2. In this case, it is worthwhile to provide at least one or some neighbouring fibres with a special marking sign at preset intervals along the length of the belt 1. The application of the special marking sign at intervals can be done e.g. for each 100, 500, 1000, . . . adjacent applied fibres or for each 100, 500, 1000, . . . grams of adjacent applied fibres.

An alternative way of providing a marking sign is to use a fibre out of a soft-magnetic material, e.g. a fibre out of a nickel alloy such as $Ni_aFe_bCr_cCo_dCu_eMo_fMn_gP_hNb_iB_jV_kSi_lC_m$, more particularly an alloy where the nickel content ranges from 52% to 85%, e.g. $Ni_{82}Fe_{14}Mo_3Mn_1$. Some of these alloys are marketed under trademarks as PERMALLOY®, VITROVAC®, . . . So instead of a carbon steel fibre, every 100th of 1000th fibre is such a magnetic fibre. This soft-magnetic fibre allows easy and remote detection.

The invention claimed is:

1. A method for dosing reinforcing fibers during manufacture of fiber concrete material or fiber composite material, said method comprising:

providing a belt comprising at least one longitudinal supporting element and the reinforcing fibers, dosing an amount of the fibers by measuring a length of said belt, and mixing said belt, having the measured length, into concrete material or composite material, wherein the fibers are applied transversely or under an angle different from 0° with respect to the at least one longitudinal supporting element, and are parallel to and next to each other, wherein all the fibers are glued to at least one longitudinal supporting element with a water soluble glue such that all the fibers are connected to and contact at least one longitudinal supporting element, and wherein the at least one longitudinal supporting element comprises a flat strip having two substantially flat major surfaces.

2. A method according to claim 1, wherein the at least one longitudinal supporting element is formed by the strip, such that a width of the strip is smaller than a length of the reinforcing fibers.

3. A method according to claim 1, wherein the belt comprises two longitudinal supporting elements, which form side edges of the belt.

4. A method according to claim 1, wherein the fibers comprise a first type of fiber and a second type of fiber differing in appearance from the first type of fiber, the second type of fiber being distributed along a length of the at least one longitudinal supporting element at preset intervals.

5. A method according to claim 1, wherein the at least one longitudinal supporting element is disintegratable into the concrete or composite material.

6. A method according to claim 5, wherein the at least one longitudinal supporting element comprises water soluble material.

7. A method according to claim 1, wherein the at least one longitudinal supporting element is made from glass or steel.

8. A belt for dosing reinforcing fibres during manufacture of fiber concrete material or fiber composite material, said belt comprising:

at least one longitudinal supporting strip and reinforcing fibers, wherein the fibers are applied transversely or under an angle different from 0° with respect to the at least one longitudinal supporting strip and are parallel to and next to each other, wherein all the fibers are glued to at least one longitudinal supporting strip with a water soluble glue such that all the fibers are connected to and contact at least one longitudinal supporting strip, wherein the fibers are steel fibers, wherein a diameter of the fibers varies from 0.10 mm to 1.4 mm and a length-diameter ratio varies between 10 and 200, wherein the belt is configured such that an amount of a dose of said fibers is determined by a length of the belt, and wherein the at least one longitudinal supporting strip comprises a flat strip having two substantially flat major surfaces.

9. The belt of claim 8, wherein at least one longitudinal supporting strip is disintegratable into the concrete or composite material.

10. The belt of claim 8, wherein at least one longitudinal supporting strip comprises water soluble material.

11. The method of claim 1, wherein at least one longitudinal supporting element comprises two substantially flat structures.

12. The belt of claim 8, wherein at least one longitudinal supporting strip comprises two substantially flat structures.

13. The method of claim 1, wherein the fibers are disposed so as to be mutually parallel to each other along the length of at least one longitudinal supporting element.

14. The belt of claim 8, wherein the fibers are disposed so as to be mutually parallel to each other along the length of at least one longitudinal supporting strip.

* * * * *